United States Patent [19]

Miller, Jr.

[11] 4,179,315

[45] Dec. 18, 1979

[54] SILICON STEEL AND PROCESSING THEREFORE

[75] Inventor: Clarence L. Miller, Jr., Pittsburgh, Pa.

[73] Assignee: Allegheny Ludlum Industries, Inc., Pittsburgh, Pa.

[21] Appl. No.: 868,956

[22] Filed: Jan. 12, 1978

Related U.S. Application Data

[63] Continuation of Ser. No. 696,965, Jun. 17, 1976, abandoned.

[51] Int. Cl.[2] ..... H01F 1/04

[52] U.S. Cl. ..... 148/113; 148/27; 148/31.5

[58] Field of Search ..... 148/111, 112, 113, 27, 148/31.5, 31.55; 427/130, 127, 129

[56] References Cited

U.S. PATENT DOCUMENTS

| | | | |
|---|---|---|---|
| 2,809,137 | 12/1957 | Robinson | 148/113 |
| 3,222,228 | 12/1965 | Stanley et al. | 148/16 |
| 3,583,887 | 6/1971 | Steger et al. | 148/27 |
| 3,700,506 | 10/1972 | Tanaka et al. | 148/113 |
| 3,873,381 | 3/1975 | Jackson | 148/111 |
| 3,905,842 | 9/1975 | Grenoble | 148/111 |
| 3,905,843 | 9/1975 | Fiedler | 148/111 |
| 3,932,202 | 1/1976 | Lee et al. | 148/113 |
| 3,945,862 | 3/1976 | Lee et al. | 148/113 |
| 3,957,546 | 5/1976 | Fiedler | 148/111 |
| 3,976,518 | 8/1976 | Kuroki | 148/113 |

*Primary Examiner*—L. Dewayne Rutledge
*Assistant Examiner*—John P. Sheehan
*Attorney, Agent, or Firm*—Vincent G. Gioia; Robert F. Dropkin

[57] ABSTRACT

A process for producing electromagnetic silicon steel having a cube-on-edge orientation and a permeability of at least 1870 ($G/O_e$) at 10 oersteds. The process includes the steps of: preparing a melt of a silicon steel containing from 0.02 to 0.06% carbon, from 0.0006 to 0.0080% boron, up to 0.0100% nitrogen, no more than 0.008% aluminum and from 2.5 to 4.0% silicon; casting said steel; hot rolling said steel; cold rolling said steel; decarburizing said steel; applying a refractory oxide coating containing both boron and $SiO_2$; and final texture annealing said steel.

6 Claims, No Drawings

SILICON STEEL AND PROCESSING THEREFORE

This is a continuation of application Ser. No. 696,965, filed June 17, 1976 now abandoned.

The present invention relates to an improvement in the manufacture of grain-oriented silicon steel.

U.S. Pat. Nos. 3,873,381, 3,905,842, 3,905,843 and 3,957,546 describe processing for producing boron-inhibited grain oriented electromagnetic silicon steel. Described therein are processes for producing steel of high magnetic quality from boron-bearing silicon steel melts. Through this invention, I now provide a process which improves upon those of the cited patents. Speaking broadly, I provide a process which improves upon those of said patents by incorporating controlled amounts of both boron and $SiO_2$ in the base coating, which is applied prior to the final texture anneal.

It is accordingly an object of the present invention to provide an improvement in the manufacture of grain-oriented silicon steels.

In accordance with the present invention a melt of silicon steel containing from 0.02 to 0.06% carbon, from 0.0006 to 0.0080% boron, up to 0.0100% nitrogen, no more than 0.008% aluminum and from 2.5 to 4.0% silicon is subjected to the conventional steps of casting, hot rolling, one or more cold rollings, an intermediate normalize when two or more cold rollings are employed, decarburizing, application of a refractory oxide coating and final texture annealing; and to the improvement comprising the steps of coating the surface of the steel with a refractory oxide coating consisting essentially of:

(a) 100 parts, by weight, of at least one substance from the group consisting of oxides, hydroxides, carbonates and boron compounds of magnesium, calcium, aluminum and titanium;

(b) up to 100 parts, by weight, of at least one other substance from the group consisting of boron and compounds, thereof, said coating containing at least 0.1%, by weight of boron;

(c) from 0.5 to 40 parts, by weight, of $SiO_2$;

(d) up to 20 parts, by weight, of inhibiting substances or compounds thereof; and (e) up to 10 parts, by weight, of fluxing agents;

and final texture annealing said steel with said coating thereon. For purposes of definition, "one part" equals the total weight of (a) hereinabove, divided by 100.

Specific processing, as to the conventional steps, is not critical and can be in accordance with that specified in any number of publications including U.S. Pat. No. 2,867,557 and the other patents cited hereinabove. Moreover, the term casting is intended to include continuous casting processes. A hot rolled band heat treatment is also includable within the scope of the present invention. It is, however, preferred to cold roll the steel to a thickness no greater than 0.020 inch, without an intermediate anneal between cold rolling passes; from a hot rolled band having a thickness of from about 0.050 to about 0.120 inch. Melts consisting essentially of, by weight, 0.02 to 0.06% carbon, 0.015 to 0.15% manganese, 0.01 to 0.05% of material from the group consisting of sulfur and selenium, 0.0006 to 0.0080% boron, up to 0.0100% nitrogen, 2.5 to 4.0% silicon, up to 1.0% copper, no more than 0.008% aluminum, balance iron, have proven to be particularly adaptable to the subject invention. Boron levels are usually in excess of 0.0008%. Steel produced in accordance with the present invention has a permeability of at least 1870 ($G/O_e$) at 10 oersteds. Preferably, the steel has a permeability of at least 1900 ($G/O_e$) at 10 oersteds and a core loss of no more than 0.700 watts per pound at 17 kilogauss.

The specific mode of applying the coating of the subject invention is not critical thereto. It is just as much within the scope of the subject invention to mix the coating with water and apply it as a slurry, as it is to apply it electrolytically. Likewise, the constituents which make up the coating can be applied together or as individual layers. It is, however, preferred to have at least 0.2%, by weight, of boron and/or at least 3 parts, by weight, of $SiO_2$, in the coating. Boron levels usually do not exceed 15%. They are generally, however, below 5%. Silica levels are generally not in excess of 20 parts by weight. The additional inhibiting substances includable with the coating are usually from the group consisting of sulfur, sulfur compounds, nitrogen compounds, selenium and selenium compounds. Typical sources of boron are boric acid, fused boric acid ($B_2O_3$), ammonium pentaborate and sodium borate. Typical fluxing agents include lithium oxide, sodium oxide and other oxides known to those skilled in the art. Those skilled in the art are, of course, aware of various ways of adding silica. Colloidal silica is, however, preferred.

Also includable as part of the subject invention is the steel in its primary recrystallized state coating of the subject invention adhered thereto. The primary recrystallized steel has a thickness no greater than 0.020 inch and is, in accordance with the present invention, a suitable for processing into grain oriented silicon steel having a permeability of at least 1870 ($G/O_e$) at 10 oersteds. Primary recrystallization takes place during the final normalize.

The following examples are illustrative of several aspects of the invention.

EXAMPLE I

Samples from three heats (Heats A, B and C) of silicon steel were cast and processed into silicon steel having a cube-on-edge orientation. The chemistry of the heats appears hereinbelow in Table I.

TABLE I

| | Composition (wt.%) | | | | | | | | |
|---|---|---|---|---|---|---|---|---|---|
| Heat | C | Mn | S | B | N | Si | Cu | Al | Fe |
| A | 0.031 | 0.032 | 0.020 | 0.0011 | 0.0047 | 3.15 | 0.32 | 0.004 | Bal. |
| B | 0.032 | 0.036 | 0,020 | 0.0013 | 0.0043 | 3.15 | 0.35 | 0.004 | Bal. |
| C | 0.030 | 0.035 | 0,020 | 0.0013 | 0.0046 | 3.15 | 0.34 | 0.004 | Bal. |

Processing for the samples involved soaking at an elevated temperature for several hours, hot rolling to a nominal gage of 0.080 inch, hot roll band normalizing at a temperature of approximately 1740° F., cold rolling to final gage, decarburizing, coating as described hereinbelow in Table II, and final texture annealing at a maximum temperature of 2150° F. in hydrogen. As for Table II, and in particular the sample identification, the letter refers to the heat and the number to the sample from that heat. For example, $A_1$ refers to Heat A, Sample 1.

TABLE II

| Sample | MgO (Parts, by wt.) | $H_3BO_3$ (Parts, by wt.) |
|---|---|---|
| $A_1$ $B_1$ $C_1$ | 100 | 0 |
| $A_2$ $B_2$ $C_2$ | 100 | 2.3 (0.4% B) |

TABLE II-continued

| Sample | MgO (Parts, by wt.) | $H_3BO_3$ (Parts, by wt.) |
|---|---|---|
| $A_3$ $B_3$ $C_3$ | 100 | 4.6 (0.8% B) |

The samples were tested for permeability and core loss. The results of the tests appear hereinbelow in Table III.

TABLE III

| Sample | Permeability (at 10 $O_e$) | Core Loss (WPP at 17KB) |
|---|---|---|
| $A_1$ | 1882 | 0.736 |
| $A_2$ | 1892 | 0.725 |
| $A_3$ | 1921 | 0.668 |
| $B_1$ | 1903 | 0.708 |
| $B_2$ | 1902 | 0.708 |
| $B_3$ | 1927 | 0.677 |
| $C_1$ | 1558 | 1.27 |
| $C_2$ | 1891 | 0.697 |
| $C_3$ | 1908 | 0.677 |

The benefit of boron in the coating is clearly evident from Table III. Improvement in both permeability and core loss can be attributed thereto. Moreover, Samples $A_3$, $B_3$ and $C_3$, with more than 0.5% boron in the coating, each attained a permeability in excess of 1900 ($G/O_e$) at 10 oersteds and a core loss below 0.700 watts per pound at 17 kilogauss.

EXAMPLE II

Additional groups of samples (Group 4 through 8) were processed as were the Group 1 through 3 samples, with the exception of the coating. The coatings applied to the Group 4 through 8 samples appear hereinbelow in Table IV, along with that applied to the Group 2 and 3 samples.

TABLE IV

| Sample | MgO (Parts, by wt.) | $H_3BO_3$ (Parts, by wt.) | $SiO_2$ (Parts, by wt.) |
|---|---|---|---|
| $A_2$ $B_2$ $C_2$ | 100 | 2.3 (0.4% B) | 0 |
| $A_4$ $B_4$ $C_4$ | 100 | 2.3 | 1.8 |
| $A_5$ $B_5$ $C_5$ | 100 | 2.3 | 3.6 |
| $A_3$ $B_3$ $C_3$ | 100 | 4.6 (0.8% B) | 0 |
| $A_6$ $B_6$ $C_6$ | 100 | 4.6 | 1.8 |
| $A_7$ $B_7$ $C_7$ | 100 | 4.6 | 3.6 |
| $A_8$ $B_8$ $C_8$ | 100 | 4.6 | 7.3 |

The samples were tested for permeability and core loss. The results of the tests appear hereinbelow in Table V.

TABLE V

| Sample | Permeability (at 10 $O_e$) | Core Loss (WPP at 17 KB) |
|---|---|---|
| $A_2$ | 1892 | 0.725 |
| $A_4$ | 1899 | 0.705 |
| $A_5$ | 1901 | 0.702 |
| $B_2$ | 1902 | 0.708 |
| $B_4$ | 1909 | 0.706 |
| $B_5$ | 1923 | 0.690 |
| $C_2$ | 1891 | 0.697 |
| $C_4$ | 1892 | 0.708 |
| $C_5$ | 1899 | 0.677 |
| $A_3$ | 1921 | 0.668 |
| $A_6$ | 1933 | 0.654 |
| $A_7$ | 1929 | 0.645 |
| $A_8$ | 1925 | 0.654 |

TABLE V-continued

| Sample | Permeability (at 10 $O_e$) | Core Loss (WPP at 17 KB) |
|---|---|---|
| $B_3$ | 1927 | 0.677 |
| $B_6$ | 1936 | 0.651 |
| $B_7$ | 1934 | 0.655 |
| $B_8$ | 1928 | 0.653 |
| $C_3$ | 1908 | 0.677 |
| $C_6$ | 1914 | 0.660 |
| $C_7$ | 1901 | 0.649 |
| $C_8$ | 1908 | 0.655 |

From Table V, a further improvement in magnetic properties is attributable to the addition of $SiO_2$ to the base coating. $SiO_2$ increases permeabilities and decreases core losses. Moreover, as notable from Table VI, hereinbelow $SiO_2$ improves the insulating characteristic of the subject base coating. Table VI lists the Franklin values at 900 psi for the $C_2$, $C_4$ and $C_5$ and $C_3$, $C_6$, $C_7$ and $C_8$ samples; and as known to those skilled in the art, a perfect insulator has a Franklin value of 0, whereas a perfect conductor has a Franklin value of 1 ampere.

TABLE VI

| Sample | Franklin Value (at 900 psi) |
|---|---|
| $C_2$ | 0.97 |
| $C_4$ | 0.96 |
| $C_5$ | 0.90 |
| $C_3$ | 0.93 |
| $C_6$ | 0.95 |
| $C_7$ | 0.90 |
| $C_8$ | 0.88 |

Note how the Franklin values decrease with increasing $SiO_2$ additions. Mose favorable results were obtained when the coating contained more than 3.0 parts $SiO_2$.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. In a process for producing electromagnetic silicon steel having a cube-on-edge orientation, a permeability of at least 1900 ($G/O_e$) at 10 oersteds and a core loss of no more than 0.700 watts per pound at 17 kilogauss, which includes the steps of: preparing a melt of silicon steel consisting essentially of, by weight, from 0.02 to 0.06% carbon, from 0.015 to 0.15% manganese, from 0.01 to 0.05% of material from the group consisting of sulfur and selenium, from 0.0006 to 0.0080% boron, up to 0.0100% nitrogen, up to 1.0% copper, no more than 0.008% aluminum, from 2.5 to 4.0% silicon, balance iron; casting said steel; hot rolling said steel; cold rolling said steel; decarburizing said steel; applying a refractory oxide base coating to said steel; and final texture annealing said steel; the improvement comprising the steps of coating the surface of said steel with a refractory oxide base coating consisting essentially of:

(a) 100 parts, by weight, of at least one substance from the group consisting of oxides, hydroxides, carbonates and boron compounds of magnesium, calcium, aluminum and titanium;

(b) up to 100 parts, by weight, of other substances from the group consisting of boron and compounds thereof, said coating containing at least 0.5%, by weight, of boron;

(c) from 0.5 to 40 parts, by weight, of $SiO_2$ added as colloidal silica;

(d) up to 20 parts, by weight, of inhibiting substances; and (e) up to 10 parts, by weight of fluxing agents;

and final texture annealing said steel with said coating thereon; said steel's magnetic properties being in part, attributable to the inclusion of boron and $SiO_2$ in the base coating.

2. The process according to claim 1, wherein said melt has at least 0.0008% boron.

3. The improvement according to claim 2, wherein said coating has at least 3 parts, by weight, of $SiO_2$.

4. The process according to claim 2, wherein said inhibiting substances are from the group consisting of sulfur, sulfur compounds, nitrogen compounds, selenium and selenium compounds.

5. The process according to claim 2, wherein said hot rolled steel has a thickness of from 0.050 to about 0.120 inch and wherein said hot rolled steel is cold rolled to a thickness of no more than 0.020 inch without an intermediate anneal between cold rolling passes.

6. A cube-on-edge oriented silicon steel having a permeability of at least 1900 ($G/O_e$) at 10 oersteds and a core loss of no more than 0.700 watts per pound at 17 kilogauss, and made in accordance with the process of claim 2.

* * * * *